US006318577B1

(12) United States Patent
Suttoni et al.

(10) Patent No.: US 6,318,577 B1
(45) Date of Patent: Nov. 20, 2001

(54) THREADED DRUM

(75) Inventors: Peter G. Suttoni; Jorge Urbano, both of Charlotte, NC (US)

(73) Assignee: Hoover Materials Handling Group, Inc., Alpharetta, GA (US)

( * ) Notice: Subject to any disclaimer, the term of this patent is extended or adjusted under 35 U.S.C. 154(b) by 0 days.

(21) Appl. No.: 09/037,899

(22) Filed: Mar. 10, 1998

(51) Int. Cl.[7] ..... B65D 41/04

(52) U.S. Cl. ..... 220/288; 220/601; 220/634; 215/44; 215/329

(58) Field of Search ..... 215/44, 329; 220/288, 220/601, 634

(56) References Cited

U.S. PATENT DOCUMENTS 3,189,072 * 6/1965 Starr ..... 220/288 X
3,335,923 * 8/1967 Healy ..... 220/288 X
3,470,927 * 10/1969 Craig ..... 215/44 X
4,708,258 * 11/1987 Shaw et al. ..... 220/288
4,967,926 * 11/1990 Morris, Sr. ..... 220/323
5,096,083 * 3/1992 Shaw et al. ..... 220/304
5,560,510 * 10/1996 Grebenyuk et al. ..... 220/284
5,875,915 * 3/1999 Bradshaw et al. ..... 220/319

* cited by examiner

*Primary Examiner*—Stephen K. Cronin
(74) *Attorney, Agent, or Firm*—Wood, Phillips, VanSanten, Clark & Mortimer

(57) ABSTRACT

A unitary plastic open head drum includes a cylindrical sidewall closed at a bottom end with a bottom wall and open at an upper end. A cylindrical chime is integrally formed with the sidewall at the open end. The chime comprises an annular wall having a thread extending helically about the annular wall. The thread has a depth of approximately ⅜ inch. The threaded drum cover is removably receivable on the cylindrical chime.

6 Claims, 3 Drawing Sheets

THREADED DRUM

FIELD OF THE INVENTION

This invention relates to containers and, more particularly, to a threaded plastic drum closed by a threaded drum cover.

BACKGROUND OF THE INVENTION

In one form of a conventional shipping and storage container, an enlarged drum is used. The drum may be, for example, a fifty-five gallon drum. Such drums have found wide usage for shipping and storing liquid or granular products. For example, such drums have been used for storing food products and for storing hazardous products.

A typical drum includes a tubular sidewall closed at one end by a bottom wall and at another end by a top wall. Such containers may have a fiber board sidewall and metal top and bottom walls, or may be made entirely of metal. Drums of fiber board are generally not suitable for carrying liquids. While metal drums are, they tend to be expensive and heavy and are not usable in the food industry unless made of stainless steel.

Such drums are classified as open head drums or tight head drums. With a tight head drum the top wall is generally permanently affixed to the sidewall. The top wall includes relatively small openings for access to the interior of the drum. Conversely, an open head drum has a cover removably received thereon. Typically, the container is filled by removing the cover.

Tight head drums can offer certain advantages in transporting the drum. For example, a device known as a "parrot beak" is often used to transport the container about in a particular location. The parrot beak device clamps about a suitably configured junction between the top wall and sidewall for lifting the drum. With many open head drums, the parrot beak would be acting on the cover and a locking band. Depending on the interlocking relationship between the cover and the drum, forces resulting from use of the parrot beak might cause the cover to separate from the drum.

More recently, plastic drums have found wide acceptance. Customers often require that the drum be a one-piece drum having an integral cover to carry liquids. Such a drum is typically made by blow molding, which is a time consuming and expensive process. Open top drums are desirable in the fact that the user can access the drum contents more easily. However, open top drums can only be used to handle non-regulated liquids or solids.

The present invention is intended to solve one or more problems discussed above in a novel and simple manner.

SUMMARY OF THE INVENTION

In accordance with the invention there is provided a threaded drum cover for selectively closing a unitary plastic open head drum to effectively provide a tight head drum.

Broadly, there is disclosed herein a threaded drum cover for selectively closing an open head drum. The drum comprises a tubular drum open at a top end defined by a threaded chime. The cover comprises a closure having a central circular wall of a size corresponding to that of the chime and a downwardly depending annular sidewall receivable radially outwardly of the chime. The sidewall includes radially inwardly directed threads for mating with a threaded chime to provide a tight head drum. A radially outwardly opening annular recess in the sidewall above the threads provides for external gripping of the tight head drum. The cover is of one piece plastic construction.

It is a feature of the invention to provide a circular ridge extending above the circular wall proximate an outer edge to define an upper circular ridge to aid in the external gripping. A second circular ridge extends upwardly from the circular wall radially inwardly of the outer circular ridge.

It is another feature of the invention that the threads comprise broken threads. The threads are provided at select circumferentially spaced locations of the sidewall.

It is an additional feature of the invention to provide a cylindrical reinforcing rib extending downwardly from the circular wall having an outer diameter slightly less than an inner diameter of a chime so that the sidewall and the rib sandwich the sidewall of the drum.

In accordance with another aspect of the invention there is disclosed a unitary plastic open head drum. The drum includes a cylindrical sidewall closed at a bottom end with a bottom wall and open at an upper end. A cylindrical chime is integrally formed with the sidewall at the open end. The chime comprises an annular wall having a thread extending helically about the annular wall. The thread has a depth of approximately ⅜ inch. The threaded drum cover is removably receivable on the cylindrical chime.

It is a feature of the invention that the thread in cross section has opposite top and bottom edges substantially perpendicular to the annular wall, an outer edge substantially perpendicular to the lower edge, and a sloped edge diagonally connecting the top edge and the outer edge. The sloped edge is sloped at an angle of approximately 30° to the top edge. Additionally, a radiused portion connects the bottom edge to the annular wall.

It is another feature of the invention that the chime has a diameter of approximately twenty-one inches.

Further features and advantages of the invention will be readily apparent from the specification and from the drawing.

DETAILED DESCRIPTION OF THE INVENTION

Figure 1:
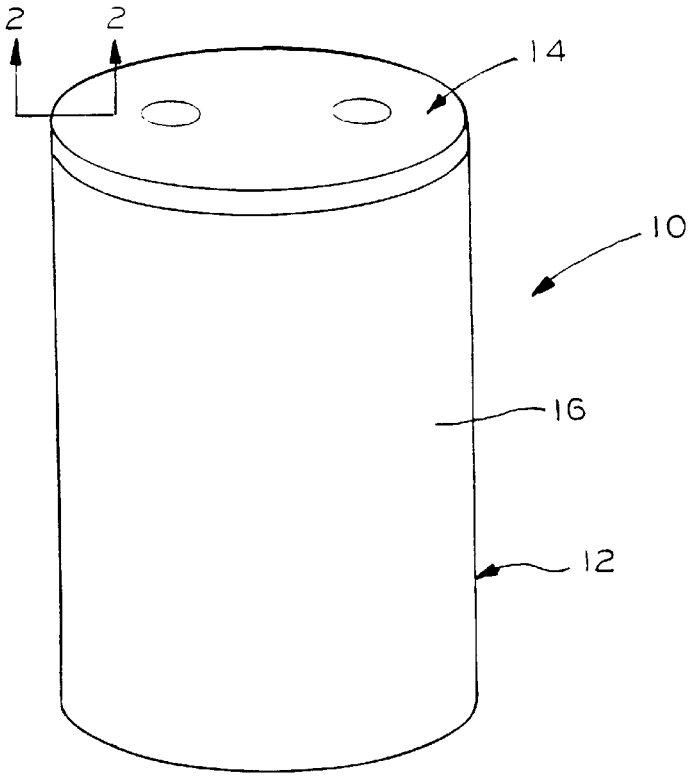
FIG. 1 is a perspective view of a unitary plastic open head drum and threaded drum cover according to the invention.

In the illustrated embodiment of the invention, as disclosed in the drawing, a container 10 is shown to comprise a unitary plastic open head drum 12 and a unitary plastic threaded drum cover 14.

Figure 3:
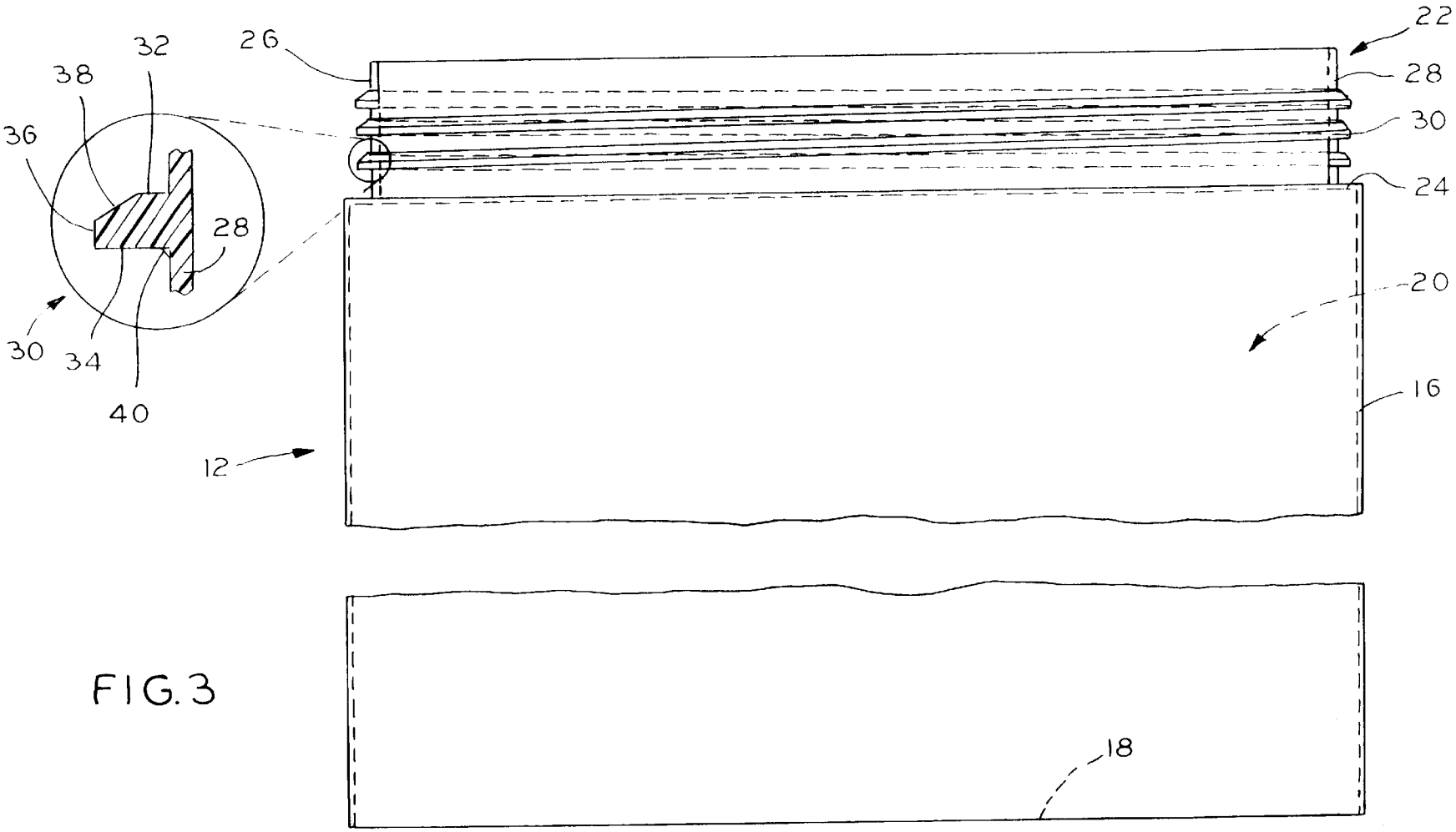
FIG. 3 is a broken, side view of the drum of FIG. 1.

With reference also to FIG. 3, the drum 12 has a right circularly cylindrical sidewall 16 connected to a bottom wall 18 to define an interior space 20. The drum 16 is open at a top end 22. Particularly, the sidewall 16 is connected to a radially inwardly turned flange 24 which is in turn connected to an upwardly extending cylindrical chime 26. The chime 26, flange 24, sidewall 16 and bottom wall 18 are integrally formed of blow molded plastic. The chime 26 comprises an annular wall 28 having a radially outwardly directed thread 30 extending helically about the annular wall 28.

As shown in expanded view in FIG. 3, the thread 30 has opposite top and bottom edges 32 and 34, respectively, substantially perpendicular to the annular wall 28. The top edge 32 is shorter than the bottom edge 34. An outer edge 36 is perpendicular to and extends upwardly from the bottom edge 34. A sloped edge 38 diagonally connects the top edge 32 and outer edge 36. The sloped edge 38 is sloped at an angle of approximately 30° to the top edge 32. The depth of the thread, defined by the length of the bottom edge 34, is approximately ⅜ inches and, in the illustrated embodiment of the invention, is 0.3885 inches. The thread 30 further comprises a radiused portion 40 connecting the bottom edge 34 to the annular wall 28. The radiused portion has a radius of approximately 0.029 inches.

In the illustrated embodiment of the invention, the drum 12 comprises a fifty-five gallon drum, and the open top end, defined by the annular wall 26, has a diameter of approximately twenty-one inches.

Figure 4:
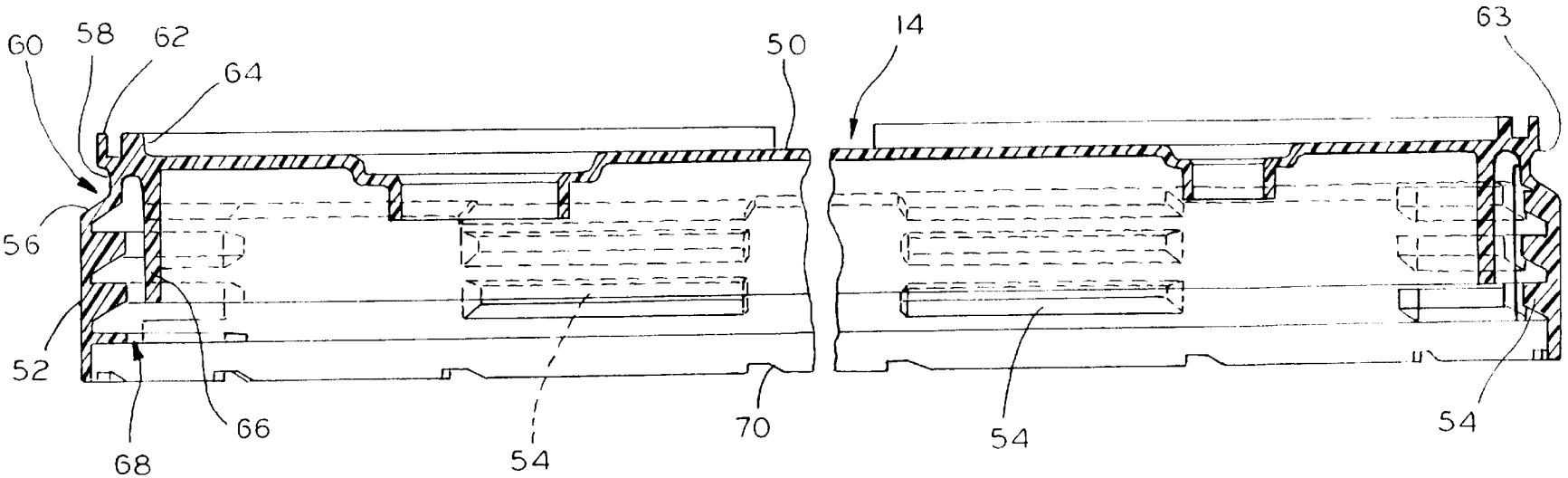
FIG. 4 is a sectional view of the cover of FIG. 1.

Referring to FIG. 4, the drum cover 14 is illustrated. The drum cover 14 is integrally formed of one-piece injection molded plastic construction. The cover 14 is in the form of a closure having a central circular wall 50 of a size corresponding to that of the chime 26, see FIG. 3. An annular sidewall 52 depends downwardly from the central circular wall 50. The sidewall 52 includes radially inwardly directed threads 54 for mating with the chime threads 30, see FIG. 2. Particularly, the threads 54 are of a size and shape corresponding to that of the chime thread 30, as is apparent.

As shown, the thread 54 extends helically about the annular sidewall 52. However, the thread 54 is periodically broken. Indeed, the thread 54 is provided at select circumferentially spaced locations of the sidewall 52, as shown in FIG. 4. This saves on plastic while also minimizing problems which might occur due to shrinkage during curing.

A top of the annular sidewall 52 is sloped diagonally inwardly at 56 and then is connected to a cylindrical portion 58, which is in turn connected to the central wall 50 to define a radially outwardly opening annular recess 60. An outer circular ridge 62 extends upwardly from the central wall 50 proximate a circumferential outer edge 63. A second circular ridge 64 extends upwardly from the circular wall 50 radially inwardly of the outer circular ridge 62. The circular ridges 62 and 64 may continue about the circumference of the central wall 50 or may be broken periodically.

The annular recess 60 and the ridges 62 and 64 provide a suitable configuration for gripping by a parrot beak device for transporting the container 10.

Figure 2:
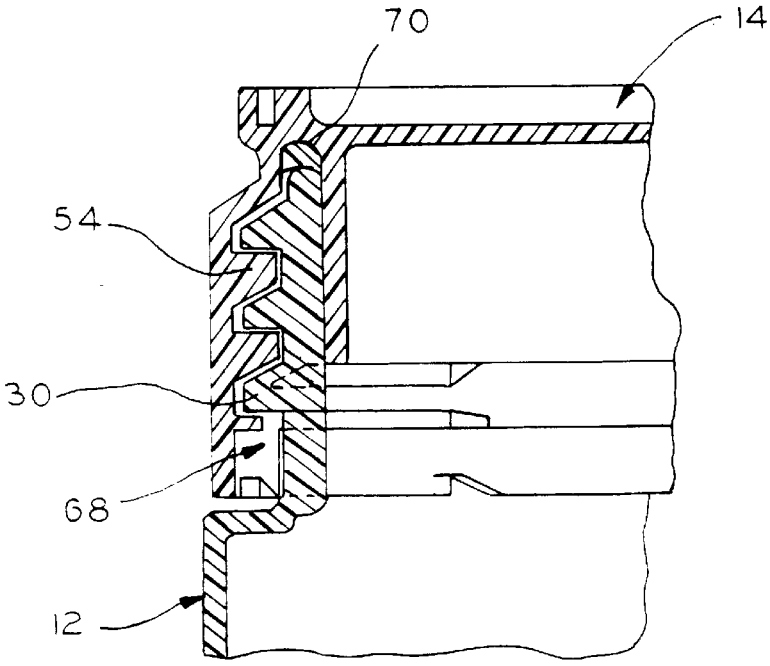
FIG. 2 is a sectional view taken along the line 2—2 of FIG. 1.

A cylindrical reinforcing rib 66 extends downwardly from the circular wall 50. The reinforcing rib 66 has an outer diameter slightly less than an inner diameter of the chime 26, see FIG. 3. The rib 66 and threaded sidewall 52 define a downwardly opening channel 68 for receiving the drum sidewall 26 sandwiched between the sidewall 52 and the rib 66. As shown in FIG. 2, a gasket 70 is provided at the top of the channel 68.

The perpendicular bottom edge of the chime thread 30 mates with a similar perpendicular shoulder formed by the sidewall thread 54 to provide a secure interlocking engagement to provide the equivalent of a tight head drum. This interlocking engagement is of sufficient strength so that when a parrot beak is used to lift the container 10 of FIG. 1, the cover 14 is securely retained on the drum 12.

Although not shown, the drum 12 may include a foot ring proximate the bottom wall 18 for holding down the drum while threading the cover 14. The cover 14 includes suitable notches 70 for torquing to suitable structure (not shown) provided on a drum. The provision of the threaded cover 14 and drum 12 eliminates the requirement for a locking band or additional structure while providing the same effect as a one-piece tight head drum while retaining a removable cover. Thus, the container 10 results in the equivalent of both a tight head and open head drum in one device. The reinforcing rim 66 and cover sidewall 52 suitably sandwich the drum sidewall 26 to provide a more solid configuration. This prevents deformation of the drum or cover from resulting in the cover being released.

Thus, the invention broadly comprehends a threaded drum cover for selectively closing a unitary plastic open head drum.

I claim:

1. A unitary plastic open head drum comprising:

a cylindrical sidewall closed at a bottom end with a bottom wall and open at an upper end;

a cylindrical chime integrally formed with the sidewall at the open end, the chime comprising an annular wall having a thread extending helically about the annular wall, the thread having a depth of approximately ⅜ inch, whereby a threaded drum cover is removably receivable on the cylindrical chime, wherein said thread in cross section has opposite top and bottom edges substantially perpendicular to the annular wall, an outer edge substantially perpendicular to the lower edge and a sloped edge diagonally connecting the top edge and the outer edge.

2. The unitary plastic open head drum of claim 1 wherein the sloped edge is sloped at an angle of approximately 30 degrees to the top edge.

3. The unitary plastic open head drum of claim 1 further comprising a radiused portion connecting the bottom edge to the annular wall.

4. A unitary plastic 55-gallon drum comprising:

A cylindrical side wall closed at a bottom end with a bottom wall and open at an upper end; and A cylindrical chime integrally formed with the side wall at the open end, the chime having a diameter of approximately twenty-one inches, the chime comprising an annular wall having a thread extending helically about the annular wall, the thread having a depth of approximately ⅜ inch, said thread in cross section having opposite top and bottom edges substantially perpendicular to the annular wall, an outer edge substantially perpendicular to the lower edge and a sloped edge diagonally connecting the top edge and the outer edge, whereby a threaded drum cover is removably receivable on the cylindrical chime.

5. The unitary plastic 55-gallon drum of claim 4 wherein the sloped edge is sloped at an angle of approximately 30 degrees to the top edge.

6. The unitary plastic 55-gallon drum of claim 4 further comprising a radiused portion connecting the bottom edge to the annular wall.

* * * * *